United States Patent [19]

Cunningham

[11] 3,950,474

[45] Apr. 13, 1976

[54] METHOD OF MANUFACTURING CONTAINER PACKAGE

[75] Inventor: Ernest Ray Cunningham, Libertyville, Ill.

[73] Assignee: Grip-Pak, Inc., St. Louis, Mo.

[22] Filed: Nov. 12, 1973

[21] Appl. No.: 415,088

Related U.S. Application Data

[62] Division of Ser. No. 243,357, April 12, 1972, Pat. No. 3,785,484.

[52] U.S. Cl. ..... 264/147; 428/43; 428/131; 264/145; 264/DIG. 47; 264/DIG. 81

[51] Int. Cl. ..... B29h 7/18; B32b 3/10

[58] Field of Search .... 264/145, 150, 154, DIG. 47, 264/DIG. 81, 138, 167, 177 R, 209, 210 R, 147, 146; 161/109, 110

[56] References Cited

UNITED STATES PATENTS

| | | | |
|---|---|---|---|
| 3,385,626 | 4/1968 | Wozniak | 206/150 |
| 3,714,310 | 1/1973 | Gaffney et al. | 264/154 |
| 3,825,465 | 7/1974 | Stock | 161/109 |
| 3,864,198 | 2/1975 | Jackson | 264/46 |

*Primary Examiner*—Donald J. Arnold
*Assistant Examiner*—John Parrish
*Attorney, Agent, or Firm*—Michael Kovac

[57] ABSTRACT

The method for manufacturing interconnected multi-packaging devices from elongated flattened plastic tubular elements is disclosed.

5 Claims, 15 Drawing Figures

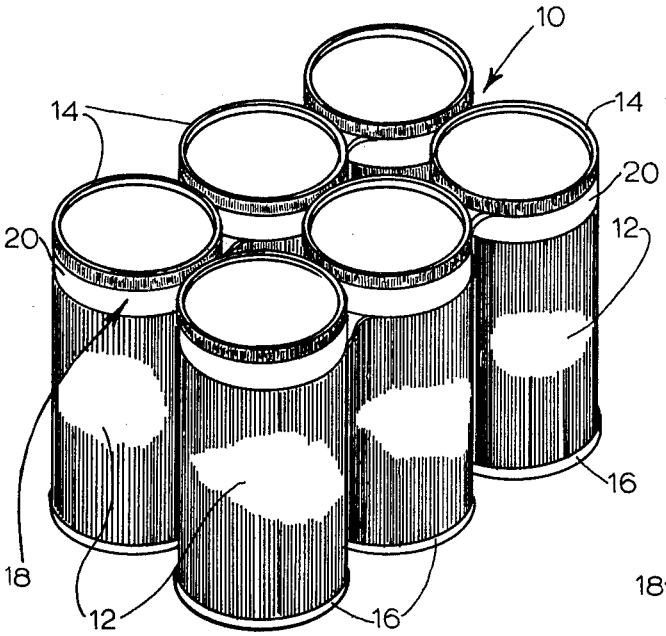
Fig 1
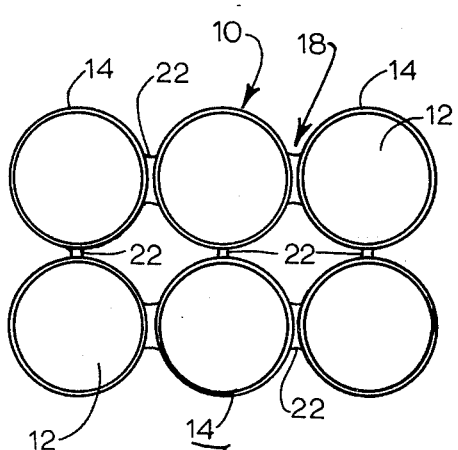
Fig 2
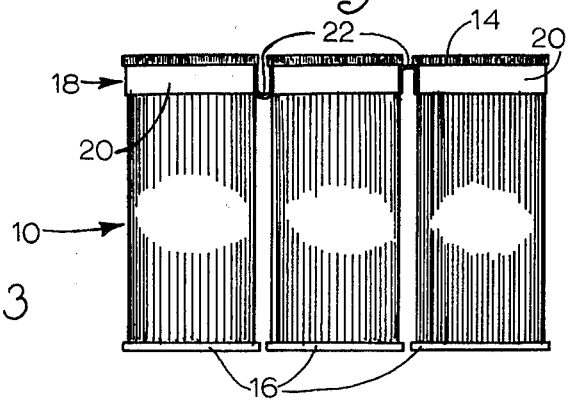
Fig 3
Fig 4
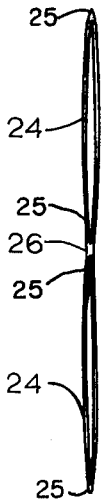
Fig 5
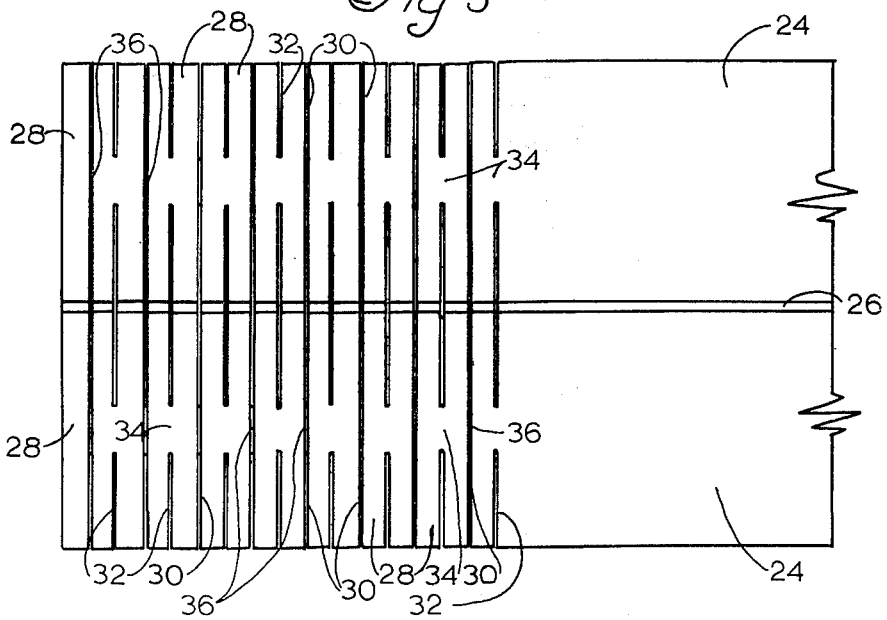

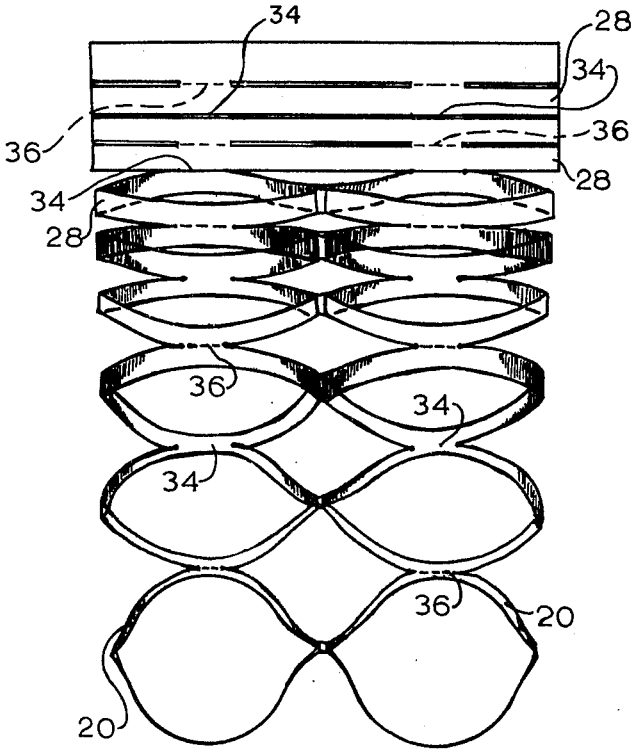
Fig 6
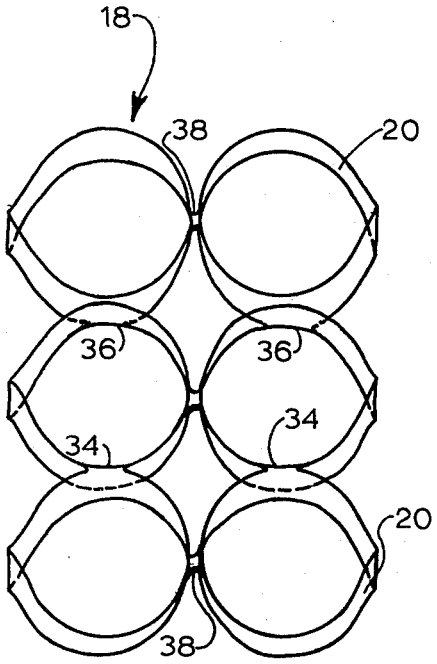
Fig 7
Fig8
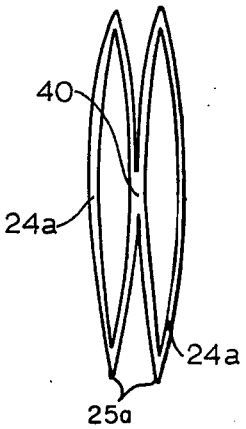
Fig 9
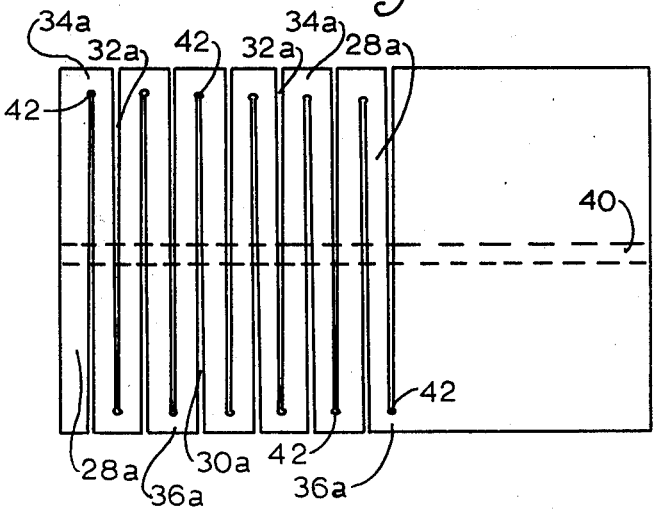

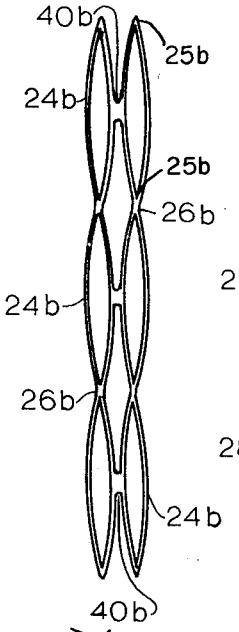
Fig 10
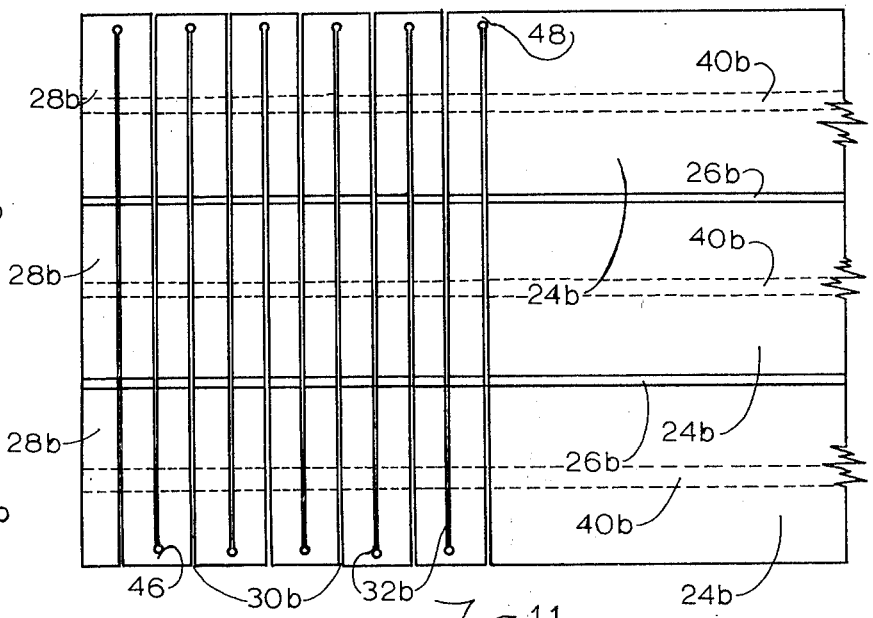
Fig 11
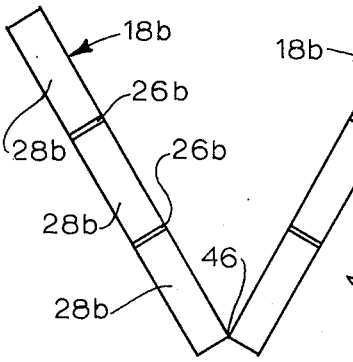
Fig 12
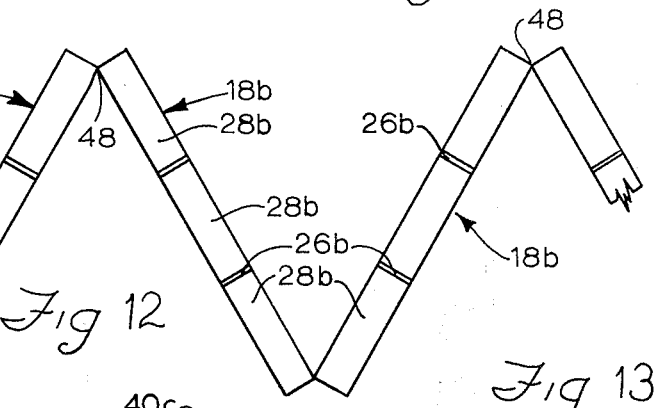
Fig 13
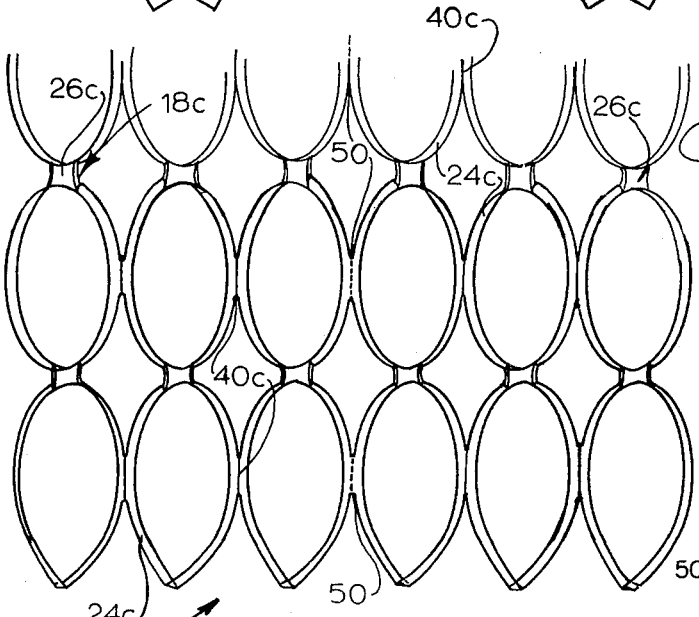
Fig 15
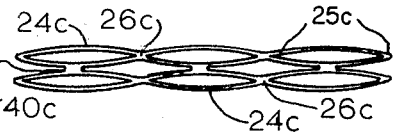
Fig 14
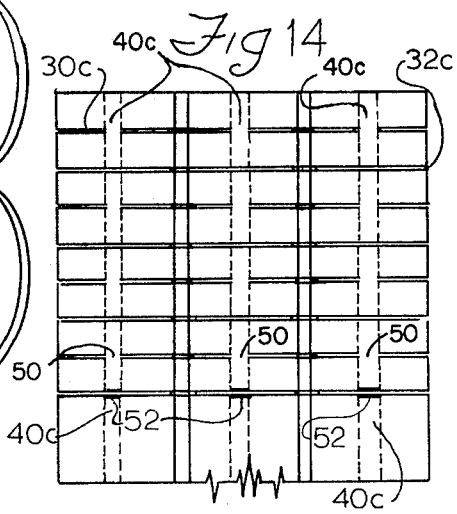

METHOD OF MANUFACTURING CONTAINER PACKAGE

SUMMARY OF THE INVENTION

This is a divisional application from copending patent application Ser. No. 243,357 filed Apr. 12, 1972, now U.S. Pat. No. 3,785,484.

It is the common practice today to multi-package a plurality of canned products together as a group through the use of apertured plastic sheet carrier devices, wrap-around cardboard devices or shrinkwrap plastic tubing devices. Each of the known devices have features which make them advantageous for particular container applications. From the standpoint of market penetration; however, apertured plastic sheet carrier devices of the type disclosed in U.S. Pat. No. 2,874,835 have had the widest impact in the can multi-packaging field because of the economic advantages over other multi-packaging devices and their adaptability to high speed applicating equipment. The present invention is directed to a method for manufacturing a plastic multi-packaging device from elongated flattened plastic tubular elements which multi-packaging device when assembled to containers, is generally similar to apertured plastic sheet carrier devices.

Apertured sheet plastic carrier devices are stamped from a ribbon or web of plastic material, wound about a reel for storage purposes, and then unwound from the reel for assembly to cans by high speed applicating equipment. Even though apertured sheet plastic carrier devices have embodied the best efforts of those concerned in its development, such devices have disadvantages particularly in the efficient utilization of material from a manufacturing, storage and use standpoint. More specifically, apertured sheet plastic carrier devices produce a large amount of scrap during manufacture, require special storage and shipping reels, and demand certain sheet material thicknesses and machinery requirements due to the manner in which the material which surrounds the apertures in the plastic sheet is stretched and deformed to the shape of tubular necks prior to the application to containers.

Accordingly, it is an object of the present invention to provide a new and improved method for manufacturing plastic multi-packaging carrier devices for containers.

The method of the present invention is achieved by forming, in elongated flattened tubes of stretchable and elastic plastic material, a plurality of pairs of parallel slits each defining flattened material bands with connecting webs between the flattened bands which provide an interconnected series of flattened material bands.

BRIEF DESCRIPTION OF THE DRAWINGS

FIG. 1 is a perspective view of a container package including a plurality of canned products and a plastic multi-packaging or carrier device which can be formed in accordance with the method of the present invention;

FIG. 2 is a top plan view of the container package shown in FIG. 1 of the drawings on a slightly smaller scale;

FIG. 3 is a side elevational view of the container package shown in FIG. 1 on a scale similar to FIG. 2;

FIG. 4 is an end elevational view of an interconnected pair of flattened tubular elements from which the form of multi-packaging or carrier device shown in FIG. 1 may be formed;

FIG. 5 is a top plan view of an interconnected series of flattened material bands of the type which forms the multi-packaging device shown in FIGS. 1–3 of the drawing;

FIG. 6 is a top perspective view of the interconnected series of flattened material bands shown in FIG. 5 of the drawings, but illustrating how the flattened bands are opened up to form multipackaging devices;

FIG. 7 is a top perspective view of a plastic multi-packaging device which is formed from the interconnected series of flattened material bands shown in FIGS. 5–6 of the drawings;

FIG. 8 is an end elevational view of an interconnected pair of flattened tubular elements which are connected along the sides thereof;

FIG. 9 is a top plan view of an interconnected series of flattened material bands which are formed in a preselected pattern from the tubular elements shown in FIG. 8 of the drawings;

FIG. 10 is an end elevational view illustrating a plurality of interconnected pairs of flattened tubular elements from which a modified form of multi-packaging device may be formed;

FIG. 11 is a top plan view depecting the manner in which an interconnected series of flattened material bands can be formed from the plurality of pairs of tubular elements shown in FIG. 10 to form multi-packaging devices;

FIG. 12 is a side elevational view illustrating a plurality of multi-packaging devices which are formed from the preselected pattern shown in FIG. 11 with each multi-packaging device being connected on opposite alternating ends to an adjacent multi-packaging devices;

FIG. 13 is a view similar to FIG. 10 wherein a plurality of pairs of interconnected flattened tubular elements are shown;

FIG. 14 is a top plan view of the device shown in FIG. 13 showing a preselected pattern from which another modified form of multi-packaging device may be formed;

FIG. 15 is a top plan view of the modified form of multipackaging devices which are formed from the preselected pattern of FIG. 14 with the multi-packaging devices being connected along the sides thereof.

DESCRIPTION OF THE PREFERRED EMBODIMENTS

It will be apparent from the discussion that is to follow that whereas the prior art apertured sheet plastic carrier devices are formed or stamped from a sheet or web of plastic material, the multi-packaging or carrier devices produced by the method of the present invention are formed from flattened tubular plastic elements. This background understanding is important in order to appreciate the structural and functional improvements of the present invention over the prior art, as will now be described.

The container package 10 shown in FIGS. 1–3 of the drawings includes a plurality of cans or containers 12 which are arranged in the well known 6-pak multi-package configuration. Each of the cans 12 are depicted as having upper and lower annular enlargements or chimes 14, 16 at opposite ends thereof. In addition to cans with upper and lower annular enlargements as illustrated in the drawings, carriers formed by the method of the present invention have equal application to containers with an upper enlargement only or with no annular enlargements at all, although preferably there is at least an upper annular enlargement for each can.

Each can 12 is gripped and held together as a unit in the container package 10 by the multi-packaging or carrier device 18. It will be noted, from FIGS. 1–3 of the drawings, that the multi-packaging device 18 includes a plurality of interconnected circumferential bands of material 20 which grip each can 12 preferably immediately below the upper annular enlargements 14 thereof. Each of the circumferential bands of material 20 is joined to an adjacent band through connecting webs 22, which are more specifically identified as described hereinafter.

In order to grip the cans 12 in the aforesaid manner, the multi-packaging device 18 is formed from a flattened tubular element of stretchable and elastic plastic material, polyethylene being one preferred example, It will be apparent that the circumferential bands of material 20 are arranged to have a peripheral dimension, prior to assembly to the cans 12, such that the material bands 20 can be stretched over the cans, by suitable applicating equipment, into elastic and embracing gripping relationship relative to the cans 12. When so assembled to the cans 12, the multi-packaging device 18 forms a container package 10 where the cans 12 are held together as a group for carrying and transporting purposes. It will be noted, from FIG. 2 of the drawings, that the fingers of a user may be inserted into the diamond shaped openings formed by the container package 10 for gripping the sides of the intermediate or central cans 12 for lifting and transporting the container package 10.

Reference is now made to FIGS. 4–7 of the drawing for an understanding of how the multi-packaging device 18 is made and constructed. In FIG. 4 of the drawings, there is shown a pair of integrally continuous flattened tubular elements 24 each having appeared folded ends 25 which are joined together at one folded end 25 thereof as at 26. While the interconnected flattened tubular elements 24 may be formed in any suitable manner, they are preferably profile extruded in generally the form illustrated in FIG. 4. It will be apparent that the tubular elements 24 will be more nearly flattened during the fabrication of the multi-packaging device 18 than the slightly exaggerated spacing between the walls of the tubular elements in this and subsequent embodiments to be described. Also, the tubular elements 24 may be extruded in a more rounded elliptical or circular shape and then subsequently flattened before being fabricated into multi-packages. The portion 26 which joins the flattened tubular elements 24 is a thickened web which connects the flattened tubular elements 24 at one folded end 25 thereof.

After the flattened tubular elements 24 have been formed in generally the manner exhibited in FIG. 4 of the drawings, it is then possible to form an interconnected series of flattened material bands to provide multi-packaging devices 18. As is best seen in FIG. 5 of the drawings, this is accomplished by slitting the flattened tubular elements 24 so as to provide a plurality of interconnected flattened material bands 28. Each of the material bands 28 is formed by a pair of parallel slits 30, 32 which extend throughout the flattened tubular elements 24 except at the connecting webs 34, 36 respectively. It will be seen that each pair of slits 30, 32 is formed to provide a pair of connecting webs 34, 36 on each side of the thickened web 26 connecting the flattened tubular elements 24. It will be noted that the full and dotted line impressions of each pair of connecting webs 34, 36 that the connecting webs are provided on opposite walls of the flattened tubular elements 24 in order to permit the flattened bands 28 to open up and form the tubular or circumferential bands 20 of the multi-packaging device 18 for assembly to the cans 12.

This is best seen in FIG. 6 of the drawings where the flattened bands 28 are shown from the flattened to the fully opened position. As will be apparent, the opposite, alternating arrangement of the connecting webs 34, 36 for each flattened material band enables the bands 28 to open up in a continuous succession of multi-packaging devices 18. This will permit the multi-packaging devices 18 to feed one another during the assembly thereof by applicating equipment to cans 12. It is contemplated that the multi-packaging device 18 will be separated from the interconnected series of material bands after assembly to the cans 12.

When fully opened, a multi-packaging device 18 will closely resemble the configuration illustrated in FIG. 7 of the drawings. As will be seen, each of the interconnected bands of material 20 assumes a generally tubular shape when opened up. This makes it unnecessary for each of the generally tubular bands 20 to be stretched to form tubular necks as in the case of apertured sheet plastic carriers prior to assembly to cans. The tubular bands of material 20 as in the present invention also makes it possible to predetermine the thickness or gauge of the walls of the tubular bands 20 so as to provide the least usage of material. In the prior art apertured sheet plastic carrier devices, the apertures are non-uniformly stretched to the shape of tubular necks prior to the assembly to cans and this makes it difficult to control or utilize the least amount of material for multi-packaging applications. With the present invention; however, the opening up of the material bands to the shape illustrated in FIG. 7 of the drawings makes it possible to uniformly stretch the tubular bands 20 for application to cans 12 as well as control the band thickness with more preciseness.

The connecting webs 34, 36 interconnect opposite, alternating marginal edges of adjacent material bands 20. This results in a multi-pack aging device 18, as illustrated in FIG. 3 of the drawings, where the connecting webs (generally designated by numeral 22) join adjacent material bands 20 upper and lower marginal edges thereof. This will not affect the performance of the multi-packaging device 18 since the material bands 20 are capable of engaging the cans 12 at generally the same circumferential location thereof. While the connecting webs 34, 36 as shown in FIG. 7, join the material bands 20 in the same row, the connecting webs 38 join opposite material bands 20 in adjacent rows. The connecting web 38 is formed from the thickened web 26 when the slits 30, 32 are formed in the flattened tubular elements 24. As will be noted, the connecting webs 38 in the multi-packaging device 18 are smaller than the connecting webs 34, 36 since the thickness of the thickened web 26 is less than the width of the connecting webs 34, 36.

Where a single row of interconnected material bands is desired, it will be apparent that the slits 30, 32 with the corresponding connecting webs 34, 36 respectively need to be formed only in a single flattened tubular element 24. It will be apparent from the other embodiments of the present invention, that more than two tubular elements 24 may be extruded, depending on the particular multi-packaging device that is desired.

In the other embodiments of the present invention that will now be described, similar reference numerals will be used to designate like parts in the various embodiments with the use of alphabetical suffixes to distinguish between the various embodiments.

As is illustrated in FIGS. 8–9 of the drawings, a multi-packaging device 18 of the type illustrated in FIG. 7 of the drawings may be formed by a different construction of the flattened tubular elements and the manner in which the tubular elements are slit. Specifically, the flattened tubular elements 24a are attached to an intermediate section 40 along the sides at maximum flattened dimension thereof rather than at one end of the tubular elements as shown in the FIG. 4 illustration. In order to form the multi-packaging device 18 in FIG. 7 a plurality of pairs of parallel slits 30*a*, 32*a* are formed in each of the superimposed tubular elements except at opposite ends thereof. Thus, the slit 30*a* extends throughout each of the superimposed tubular elements 24*a*, but terminates short of the upper end of the tubular elements as illustrated in FIG. 9 while the slit 32*a* extends throughout each of the superimposed tubular elements 24*a* from the upper end thereof, but terminates short of the lower end thereof in FIG. 9. Each of the slits 30*a*, 32*a* are terminated at opposite ends by the small circular holes 42 which prevent the slits from tearing into the plastic material. The unslit areas of the tubular elements 24*a* at opposite ends thereof form the connecting webs 34*a*, 36*a* which join adjacent material bands 28*a* in the same row while the thickened connecting section 40, when severed by the slits 30*a*, 32*a* forms the connecting or joining section between opposite material bands in adjacent rows.

Reference is now made to the embodiment shown in FIGS. 10–12 of the drawings. In FIG. 10, there is illustrated a plurality of pairs of interconnected flattened tubular elements 24*b* where each pair of tubular elements 24*b* are joined to each other along the sides at maximum flattened dimensions thereof at an intermediate portion 40*b* while adjacent pairs of tubular elements 24*b* are joined to one another at one end thereof as at 26*b*. Thus, the arrangement is a combination of the method of joining the tubular elements to one another as illustrated in FIGS. 4 and 8 of the drawings.

As has previously been explained, the tubular elements 24*b* may be extruded in generally the flattened shape illustrated or in a more opened up form and subsequently flattened following extrusion. In either case, the arrangement of the tubular elements 24*b* is generally that which is illustrated in FIG. 10 of the drawings prior to forming the material bands by slitting of the tubular elements 24*b*. The spacing between the walls of each tubular element may; however, be less than that shown prior to and during the slitting operation.

In FIG. 11 of the drawings, it will be seen that the slits 30*b* and 32*b* which form the material bands 28*b* are formed throughout each of the tubular elements 24*b* except at the lower and upper ends of the tubular arrangement. Specifically, the slit 30*b* extends throughout each pair of superimposed tubular elements 24*b* except at the connecting web 46. Similarly, the slit 32*b* extends throughout the tubular elements 24*b* except at the upper end of the uppermost pair of tubular elements 24*b* where the connecting web 48 is provided. By slitting the tubular elements 24*b* in the aforesaid manner, there is provided, as best seen in FIG. 12 of the drawings, a plurality of interconnected multi-packaging devices 18*b* which are joined at opposite ends thereof by the connecting webs 46, 48 respectively. Because each of the multi-packaging devices 18*b* includes a material band 28*b* which is formed from each of the tubular elements 24*b*, the connecting webs 26*b*, 40*b* which connect material bands 28*b* in the same and adjacent rows will be of substantially uniform size as compared with the non-uniform in size connecting webs 34, 36 and the connecting webs 38 in the FIGS. 1–9 embodiments. The uniform or non-uniform size of the connecting webs results from the manner in which the tubular elements are connected to one another and the method of slitting, but in either case, they do not affect the functioning of the multi-packaging device.

The embodiments shown in FIGS. 13–15 of the drawings is similar to FIGS. 10–12 except that in this case, the tubular elements are slit so as to leave intermediate connecting webs between adjacent multi-packaging devices. Specifically, it will be seen that the plurality of pairs of flattened tubular elements 24*c* are connected to each other as at 40*c* and connected to adjacent pairs of tubular elements 24*c* as at 26*c*. This is the same configuration as is shown in FIG. 10 of the drawings. However, in slitting the plurality of pairs of tubular elements 24*c*, the slits 30*c*, 32*c* are arranged to leave opposite alternating intermediate connecting webs 50, 52 respectively so that adjacent multi-packaging devices 18*c* are connected along the sides at maximum flattened dimension thereof to one another as is best illustrated in FIG. 15 of the drawings. Thus, each multi-packaging device 18*c* will unfold with respect to an adjacent multi-packaging device by opening up along the sides rather than the end to end connected arrangement illustrated in FIGS. 10–12 of the drawings. As in the FIGS. 10–12 embodiment however, the connecting webs 26*c* and 40*c* in each multi-packaging device 18*c* will be substantially uniform in size, as will be apparent.

The various embodiments of the present invention that have been shown are to be considered in an exemplary sense only as the multi-packaging device can be manufactured and used in various multiples in single or plural rows. Also, while the discussion has centered principally on canned products, the multi-packaging device can be used with containers of other shapes and sizes. Further, adjacent tubular bands of the multi-packaging device may be frangibly connected to one another in order to keep the tubular bands with individual containers when separated from the remainder of the container package.

From the foregoing, it will not be appreciated that the method of manufacture of the present invention provides efficient and economic utilization of material during the manufacture, storage and assembly thereof to containers in a manner which has not been heretofore possible.

I claim:

1. The method of forming a scrapless multi-packaging device including the steps of extruding at least two elongated and interconnected tubes of stretchable and elastic plastic material, flattening each of said tubes to provide flattened tubular elements, forming a plurality of pairs of parallel slits in each of said flattened tubular elements which are transversely aligned across said flattened tubular elements in order that each said pair of slits defines a flattened material band in one of said flattened tubular elements which is transversely aligned with a flattened material band in at least one other flattened tubular element, and forming alternate integral marginal connecting webs between each of said flattened material bands in each said tube while said flattened tubular elements are being slit in the aforementioned manner in order to form an interconnected series of transversely aligned flattened material bands that can be automatically opened up when longitudinally stretched as a continuous non-aligned sequence of generally tubular shaped bands.

2. The method as defined in claim 1 including the steps of providing at least two flattened tubular elements which are interconnected at the ends thereof and forming the plurality of pairs of parallel slits and connecting webs between the flattened bands of material defined thereby by slitting each of said flattened tubes throughout except at opposite alternating connecting webs on each said tubes.

3. The method as claimed in claim 1 including the steps of providing at least two flattened tubular elements which are interconnected in superimposed relationship to one another and forming the plurality of pairs of parallel slits and connecting webs between the flattened bands of material defined thereby by slitting each of said superimposed flattened tubes throughout except at the ends of each tube which form the connecting webs between the flattened bands of material.

4. The method as defined in claim 1 including the steps of providing a plurality of interconnected pairs of flattened tubular elements, and forming the plurality of pairs of parallel slits and connecting webs between the flattened bands of material defined thereby by slitting each of said plurality of interconnected pairs of flattened tubular elements throughout except at opposite alternating connecting webs on opposite alternating ends of the flattened tubular elements.

5. The method as defined in claim 1 including the steps of providing a plurality of interconnected pairs of flattened tubular elements, and forming the plurality of pairs of parallel slits and connecting webs between the flattened bands of material defined thereby by slitting each of said plurality pairs of flattened tubular elements throughout except at opposite alternating webs on opposite alternating sides of flattened tubular elements.

* * * * *